US006209202B1

(12) United States Patent
Rhodes et al.

(10) Patent No.: US 6,209,202 B1
(45) Date of Patent: Apr. 3, 2001

(54) FOLDED TUBE FOR A HEAT EXCHANGER AND METHOD OF MAKING SAME

(75) Inventors: Eugene E. Rhodes, Belleville; Greg Whitlow, Whitmore Lake; Wen F Yu, Plymouth, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/365,030

(22) Filed: Aug. 2, 1999

(51) Int. Cl.[7] ..... B23P 15/26; F28F 1/06
(52) U.S. Cl. ..... 29/890.053; 165/177; 165/183
(58) Field of Search ..... 165/177, 183; 29/890.053

(56) References Cited

U.S. PATENT DOCUMENTS

| | | | |
|---|---|---|---|
| 349,060 | 9/1886 | Serve . | |
| 992,763 | 5/1911 | Fedders . | |
| 1,302,627 | 5/1919 | Boblett . | |
| 1,316,199 | 9/1919 | Spery . | |
| 2,017,201 | 10/1935 | Bossart et al. . | |
| 2,043,496 | 6/1936 | Schneider . | |
| 2,093,256 | 9/1937 | Still . | |
| 2,151,540 | 3/1939 | Varga . | |
| 2,321,755 | 6/1943 | Kost . | |
| 2,396,522 | 3/1946 | Modine . | |
| 2,462,136 | 2/1949 | Smith . | |
| 2,554,185 | 5/1951 | Giegerich . | |
| 2,663,072 | 12/1953 | Pfistershammer . | |
| 2,825,996 | 3/1958 | Grant . | |
| 3,258,832 | 7/1966 | Gerstung . | |
| 3,341,925 | 9/1967 | Gerstung . | |
| 3,603,384 | 9/1971 | Huggins et al. . | |
| 3,662,582 | 5/1972 | French | 165/177 X |
| 3,757,856 | 9/1973 | Kun . | |
| 4,081,025 | 3/1978 | Donaldson . | |
| 4,558,695 | 12/1985 | Kumazawa et al. . | |
| 4,570,700 | 2/1986 | Ohara et al. . | |
| 4,715,432 | 12/1987 | Paikert . | |
| 4,766,953 | 8/1988 | Grieb et al. . | |
| 4,788,395 | 11/1988 | Sakoda . | |
| 4,805,693 | 2/1989 | Flessate | 165/153 |

(List continued on next page.)

FOREIGN PATENT DOCUMENTS

| | | | | |
|---|---|---|---|---|
| 1 094 277 | | 12/1960 | (DE) . | |
| 302232 | * | 7/1988 | (EP) | 165/177 |
| 359192 | | 3/1906 | (FR) . | |
| 545200 | | 10/1922 | (FR) . | |
| 1140305 | | 7/1957 | (FR) . | |
| 19219 | * | of 1908 | (GB) | 165/183 |
| 19348 | | of 1914 | (GB) . | |
| 12067 | | 8/1916 | (GB) . | |
| 222445 | | 4/1925 | (GB) . | |
| 247935 | * | 7/1926 | (GB) | 165/177 |
| 528297 | | 10/1940 | (GB) . | |
| 683161 | | 11/1952 | (GB) . | |
| 61-66091 | | 4/1986 | (JP) . | |
| 2-84252 | | 3/1990 | (JP) . | |
| 2-84255 | | 3/1990 | (JP) . | |
| 3-155422 | | 7/1991 | (JP) . | |
| 5-45082 | * | 2/1993 | (JP) | 165/183 |
| 5-164484 | | 6/1993 | (JP) . | |

*Primary Examiner*—Leonard Leo
(74) *Attorney, Agent, or Firm*—Larry I. Shelton

(57) ABSTRACT

A folded tube and method of making the same for a heat exchanger includes a base, a top spaced from and opposing the base, a first side interposed between the base and the top along one side thereof, and a second side interposed between the base and the top along another side thereof. The folded tube includes at least one of the base and the top having at least one internal web having an initial web height and being compressed to extend the at least one internal web to a final web height greater than the initial web height and defining a plurality of fluid ports.

20 Claims, 4 Drawing Sheets

U.S. PATENT DOCUMENTS

| | | | |
|---|---|---|---|
| 4,825,941 | 5/1989 | Hoshino et al. . | |
| 4,932,469 | 6/1990 | Beatenbough . | |
| 4,982,784 | 1/1991 | Rhodes . | |
| 4,998,580 | 3/1991 | Guntly et al. . | |
| 5,172,476 | 12/1992 | Joshi . | |
| 5,185,925 | 2/1993 | Ryan et al. | 29/890.049 |
| 5,186,250 | 2/1993 | Ouchi et al. | 165/177 |
| 5,271,151 | 12/1993 | Wallis . | |
| 5,295,302 | 3/1994 | Takai et al. . | |
| 5,372,188 | 12/1994 | Dudley et al. . | |
| 5,386,629 | 2/1995 | Ouchi et al. . | |
| 5,441,106 * | 8/1995 | Yukitake | 165/183 |
| 5,579,837 | 12/1996 | Yu et al. | 165/183 |
| 5,689,881 | 11/1997 | Kato . | |
| 5,697,433 | 12/1997 | Kato | 165/170 |
| 5,768,782 | 6/1998 | Kato . | |
| 5,865,243 | 2/1999 | Kato et al. | 165/177 X |
| B1 4,825,941 | 7/1997 | Hoshino et al. . | |

* cited by examiner

FOLDED TUBE FOR A HEAT EXCHANGER AND METHOD OF MAKING SAME

BACKGROUND OF THE INVENTION

1. Field of the Invention

The present invention relates generally to heat exchangers for motor vehicles and, more specifically, to a folded tube and method for making same for a heat exchanger in a motor vehicle.

2. Description of the Related Art

It is known to provide a tube for a heat exchanger such as a condenser in an air conditioning system of a motor vehicle. The tube typically carries a first fluid medium in contact with its interior while a second fluid medium contacts its exterior. Typically, the first fluid medium is a liquid and the second fluid medium is air. Where a temperature difference exists between the first and second fluid mediums, heat will be transferred between the two via heat conductive walls of the tube.

It is also known to provide corrugated fins or ribs in the interior of the tube to increase the surface area of conductive material available for heat transfer to cause turbulence of the fluid carried in the interior of the tube and to increase the burst strength of the tube. One known method of making such a tube is to physically insert a corrugated fin into the generally flattened tube after the tube has been manufactured. This is an extremely difficult process since the corrugated fin to be inserted into the tube is extremely thin and subject to deformation during the insertion process.

Another known method of forming a tube for a heat exchanger is to extrude the tube in an extrusion process. In this construction, internal ribs are formed during the extrusion. However, these extruded tubes are relatively expensive to produce.

Yet another known method of forming a tube for a heat exchanger is to provide a flat, elongated sheet with lugs and the ends of the sheet are folded to form the tube. The ends of the tube are then brazed. An example of such a tube is disclosed in U.S. Pat. No. 5,386,629. In this construction, the tube may have flow paths between the lugs having a hydraulic diameter of less than 0.050 inches. Hydraulic diameter is conventionally defined as the cross-sectional area of each of the flow paths multiplied by four and divided by a wetted perimeter of the corresponding flow path. While a hydraulic diameter of less than 0.050 inches optimizes heat transfer efficiency, it is relatively expensive to produce.

Although the above tubes have worked well, they suffer from the disadvantage that the extruded tubes are relatively costly to manufacture Another disadvantage of the above tubes is that the lugs are not folded and squeezed. Yet another disadvantage of the above tubes is that the hydraulic diameter of the flow paths are not greater than 0.050 inches, making them relatively expensive to produce. Therefore, there is a need in the art to provide a folded tube for a heat exchanger of a motor vehicle that overcomes these disadvantages.

SUMMARY OF THE INVENTION

Accordingly, the present invention is a folded tube for a heat exchanger. A folded tube includes a base, a top spaced from and opposing the base, a first side interposed between the base and the top along one side thereof, and a second side interposed between the base and the top along another side thereof. The folded tube also includes at least one of the base and the top having at least one internal web having an initial web height and being compressed to extend the at least one internal web to a final web height greater than the initial web height and defining a plurality of fluid ports.

Also, the present invention is a method of making a folded tube for a heat exchanger. The method includes the steps of providing a generally planar sheet, folding the sheet, and forming at least one internal web having a first fold portion and a second fold portion. The method also includes the steps of compressing the at least one internal web to extend a height of the at least one internal web. The method further includes the steps of folding the sheet and forming a base and a top opposing the base and a first side interposed between the top and the base and a second side interposed between the top and the base such that the at least one internal web contacts either one of the top or the base to provide a plurality of fluid ports.

One advantage of the present invention is that a folded tube for a heat exchanger such as a condenser is provided for an air conditioning system of a motor vehicle for condensing liquid refrigerant. Another advantage of the present invention is that the folded tube is stamped and folded and is more economical to manufacture than an extruded tube. Yet another advantage of the present invention is that the folded tube can have multiple ports or flow paths with a hydraulic diameter greater than 0.070 inches, making it relatively inexpensive to manufacture. Still another advantage of the present invention is that the folded tube is able to meet performance requirements.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Figure 1:
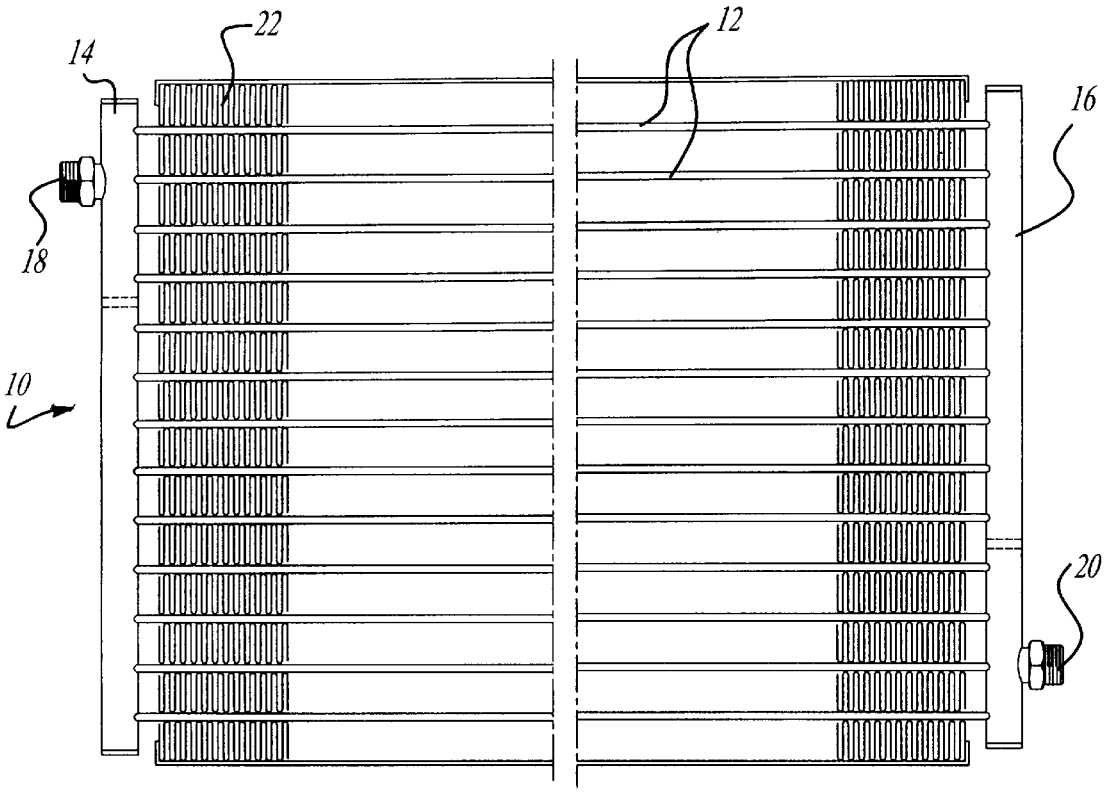
FIG. 1 is an elevational view of a folded tube, according to the present invention, illustrated in operational relationship with a heat exchanger of a motor vehicle.

Referring to the drawings and in particular FIG. 1, one embodiment of a heat exchanger 10, such as a condenser for an air conditioning system (not shown), is shown for a motor vehicle (not shown). The heat exchanger 10 includes a plurality of generally parallel folded tubes 10, according to the present invention, extending between oppositely disposed headers 14,16. The heat exchanger 10 includes a fluid inlet 18 for conducting cooling fluid into the heat exchanger 10 formed in the header 14 and an outlet 20 for directing cooling fluid out the heat exchanger 10 formed in the header 16. The heat exchanger 10 also includes a plurality of convoluted or serpentine fins 22 attached to an exterior of each of the tubes 12. The fins 22 are disposed between each of the tubes 12. The fins 22 conduct heat away from the tubes 12 while providing additional surface area for convective heat transfer by air flowing over the heat exchanger 10. It should be appreciated that, except for the folded tube 12, the heat exchanger, 10 is conventional and known in the art. It should also be appreciated that the folded tube 12 could be used for heat exchangers in other applications besides motor vehicles.

Referring to FIGS. 2 through 5, the folded tube 12 extends longitudinally and is substantially flat. The folded tube 12 includes a base 24 being generally planar and extending laterally. The folded tube 12 also includes a top 26 spaced from the base 24 a predetermined distance and opposing each other. The top 26 is generally planar and extends laterally. The folded tube 12 includes a first side 28 interposed between the base 24 and the top 26 along one side thereof. The first side 28 is generally arcuate in shape. The folded tube 12 also includes a second side 30 interposed between the base 24 and the top 26 along the other side and opposing the first side 28. The folded tube 12 has a generally rectangular cross-sectional shape. It should be appreciated that the folded tube 12 may have any suitable cross-sectional shape.

Figure 4:
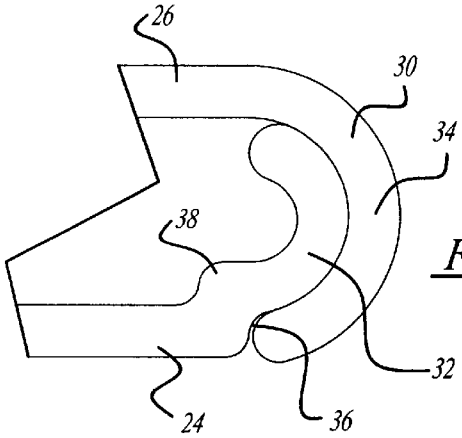
FIG. 4 is an enlarged view of a portion of the folded tube in circle 4 of FIG. 2.

Referring to FIG. 4, the second side 30 is generally arcuate in shape and formed from a first end 32 of the base 24 and a second end 34 of the top 26. The first end 32 is generally arcuate in shape and has a recess 36 formed by a shoulder 38 extending inwardly. The second end 34 is generally arcuate in shape and overlaps the first end 32 and terminates in the recess 36 to produce a substantially flush outer periphery of the second side 30. The first side 28 has a single wall thickness while the second side has a double wall thickness for extra strength against stone chips while driving the motor vehicle. Preferably, the wall thickness for the folded tube 12 has a maximum of 0.35 millimeters. It should be appreciated that the base 24, top 26, first side 28 and second side 30 form a hollow channel or interior for the folded tube 12.

Figure 2:
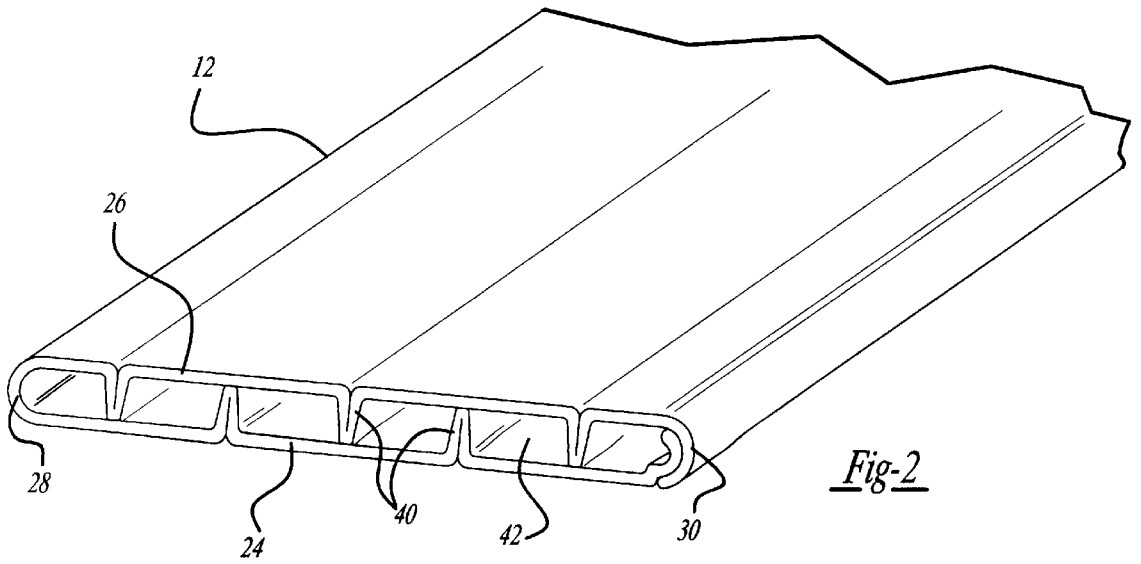
FIG. 2 is an enlarged perspective view of the folded tube of FIG. 1.
Figure 3:
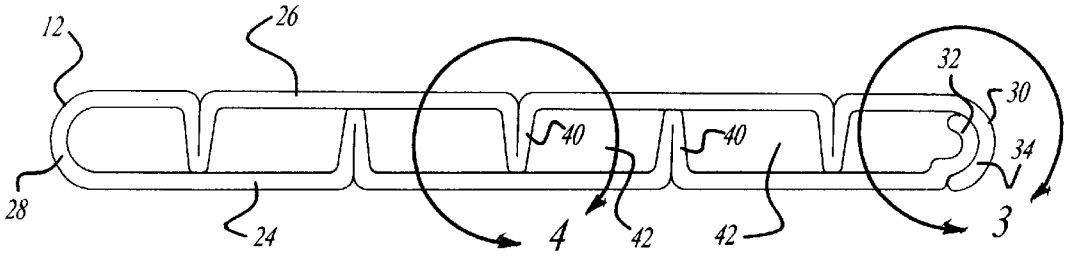
FIG. 3 is an end view of the folded tube of FIG. 1.
Figure 5:
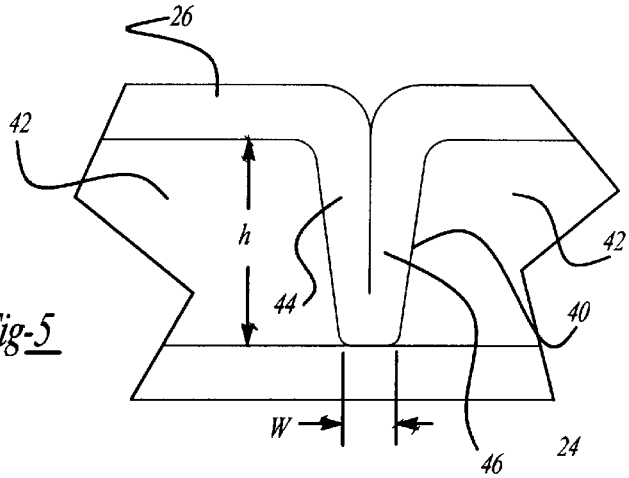
FIG. 5 is an enlarged view of a portion of the folded tube in circle 5 of FIG. 2.

Referring to FIGS. 2, 3 and 5, the folded tube 12 includes at least one, preferably a plurality of internal webs 40 extending from either one of or both the base 24 and top 26 to form a plurality of ports or flow paths 42 in the interior of the folded tube 12. In the embodiment illustrated, the base 24 has two internal webs 40 spaced laterally and extending longitudinally and upwardly. The top 26 has three internal webs 40 spaced laterally and extending longitudinally and downwardly. The internal webs 40 extend in alternate directions such that one of the internal webs 40 on the base 24 is disposed between a pair of internal webs 40 on the top 26 to form six ports 42. It should be appreciated that the number of internal webs 40 can be varied to produce the number of ports 42 desired.

Each of the internal webs 40 extends longitudinally and has a first portion 44 and a second portion 46. The internal web 40 is formed by folding the first fold portion 44 and second fold portion 46 of the base 24 and/or top 26 back on itself for an initial predetermined internal web height and a predetermined internal web width or thickness. In the embodiment illustrated, the initial predetermined internal web height is approximately 0.7812 mm with a uniform initial predetermined internal web width of approximately 0.68 mm. It should be appreciated that the initial predetermined web thickness is uniform.

After the internal web 40 is initially formed, it is compressed or laterally extruded by a conventional process such as coining to extend the height of the internal web 40. In the embodiment illustrated, the internal web 40 has a final predetermined internal web height (h) and predetermined internal web width or thickness (w). In the embodiment illustrated, the final predetermined web height (h) is approximately 1.345 mm and the final predetermined internal web thickness (w) is approximately 0.38 mm at its peak and approximately 0.68 mm at its base. The final internal web 40 is tapered at a predetermined angle. The predetermined angle is zero to seven degrees and, in the embodiment illustrated, preferably the predetermined angle is approximately 6.363 degrees. It should be appreciated that the taper angles are a result of the lateral extrusion. It should also be appreciated that the internal webs 40 have a non-uniform thickness. It should further be appreciated that the internal webs 40 maintain a predetermined distance or spacing between the base 24 and the top 26.

The folded tube 12 has the internal webs 40 laterally spaced to provide the ports 42 with a predetermined hydraulic diameter. The hydraulic diameter is defined as the cross-sectional area of each of the flow paths or ports 40 multiplied by four and divided by a wetted perimeter of the corresponding flow path or port 42. With the present invention, the hydraulic diameter of the ports range up to and beyond 0.070 inches. The hydraulic diameter is preferably smaller than 0.050 inches but heat transfer efficiency of the tubes of the present invention remain high even when they hydraulic diameter is greater than 0.070 inches. For example, the port 42 may have a cross-sectional area of 3.71 mm and a wetted perimeter of 8.25 mm for a hydraulic diameter of 0.0708 inches or 1.798 mm.

The folded tube 12 has its inner and outer surfaces coated with a known brazing material. As a result, the brazing material flows between the first end 32 of the base 24 and the second end 34 of the top 26 by capillary flow action to braze the ends together. Also, the brazing material flows between the peak of the internal webs 40 and the base 24 and top 26 to braze them together.

Figure 6:
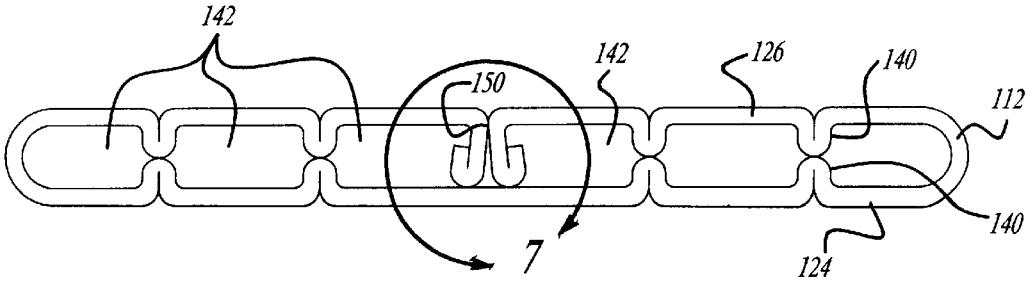
FIG. 6 is an end view of another embodiment, according to the present invention, of the folded tube of FIG. 1.
Figure 7:
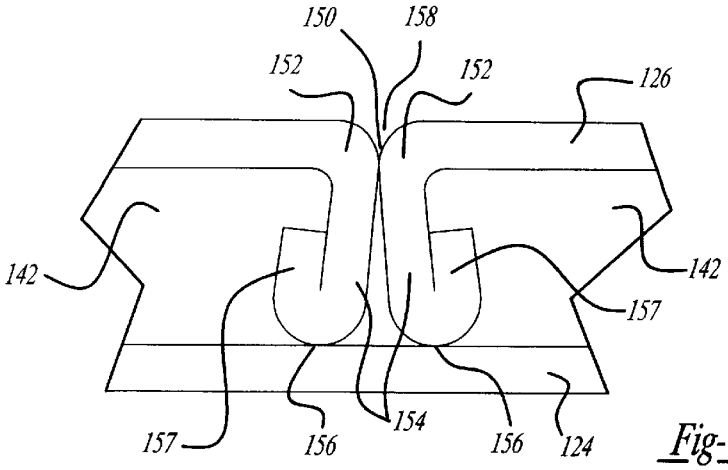
FIG. 7 is an enlarged view of a portion of the folded tube in circle 7 of FIG. 6.

Referring to FIGS. 6 and 7, another embodiment 112, according to the present invention, of the folded tube 12 is shown. Like parts of the folded tube 12 have like reference numerals increased by one hundred (100) . The folded tube 112 has the internal webs 140 extending from the base 124 and top 126 and spaced laterally such that the internal webs 140 on the base 124 and top 126 contact each other. The folded tube 112 also includes a partition 150 extending from the top 126 to the base 124 and which defines a pair of the adjacent ports 142. The partition 150 includes a pair of opposing, connecting bend portions 152 disposed at a predetermined radius of curvature toward one another. Each of the bend portions 152 includes a leg portion 154 depending from each of the bend portions 152 and which contact the base 124 at terminal ends 156. The terminal ends 156 can be either flat or include a bent over portion 157. A braze seam 158 is disposed at the top of the partition 150 along the longitudinal length of the folded tube 112. It should be appreciated that the partition 150 can be formed similar to that disclosed in U.S. Pat. No. 5,597,837.

Figure 8:
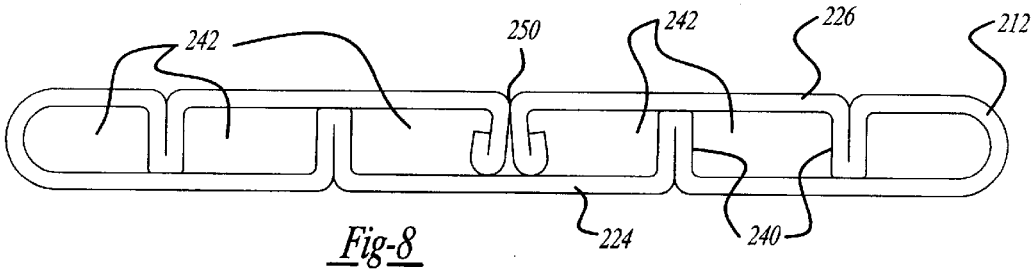
FIG. 8 is an end view of yet another embodiment, according to the present invention, of the folded tube of FIG. 1.

Referring to FIG. 8, another embodiment 212, according to the present invention, of the folded tube 12 is shown. Like parts of the folded tube 12 have like reference numerals increased by two hundred (200). The folded tube 212 has a partition 250 similar to the partition 150 of FIG. 6 extending from the top 226 to the base 224 and which defines a pair of the adjacent ports 242. The folded tube 212 also has the internal webs 240 extending from the base 224 and the top 226 in an alternating manner similar to the internal webs 40 of FIG. 1.

Figure 9:
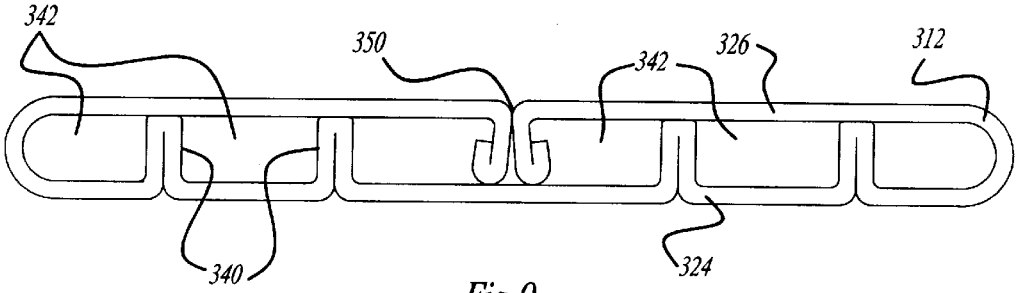
FIG. 9 is an end view of still another embodiment, according to the present invention, of the folded tube of FIG. 1.

Referring to FIG. 9, another embodiment 312, according to the present invention, of the folded tube 12 is shown. Like parts of the folded tube 12 have like reference numerals increased by three hundred (300). The folded tube 312 has a partition 350 similar to the partition 150 of FIG. 6 extending from the top 326 to the base 324 and which defines a pair of the adjacent ports 342. The folded tube 312 also has the internal webs 340 extending only from the base 324 to the top 326. The internal webs 344 are similar to the internal webs 40 of FIG. 1. It should be appreciated that the internal webs 240 extend from only one side of the folded tube 312 and may extend from the top 326 to the base 324.

Figure 10:
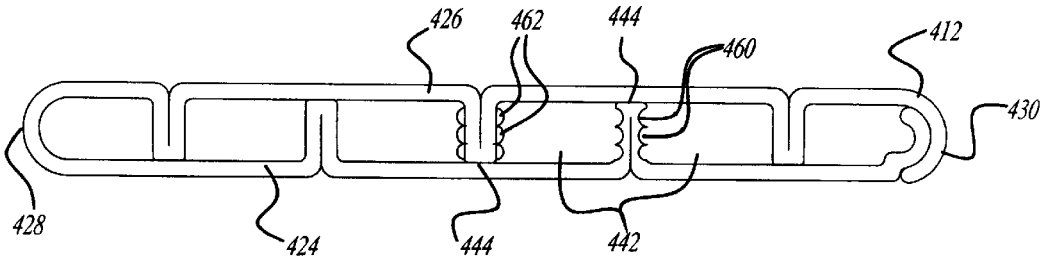
FIG. 10 is an end view of still yet another embodiment, according to the present invention, of the folded tube of FIG. 1.

Referring to FIG. 10, another embodiment 412, according to the present invention, of the folded tube 12 is shown. Like parts of the folded tube 12 have like reference numerals increased by four hundred (400). The folded tube 412 has a first side 428 and a second side 430 similar to the first side 28 and second side 30 of FIG. 1. The folded tube 412 also has the internal webs 440 extending between the base 424 to the top 426. The internal webs 344 are similar to the internal webs 40 of FIG. 1 except that the internal webs 444 may include recesses 460 or projections 462 to enhance fluid flow through the ports 442. It should be appreciated that the internal webs 440 can have a uniform or non-uniform width and may extend from the top 426 or the base 424.

Figure 11A:
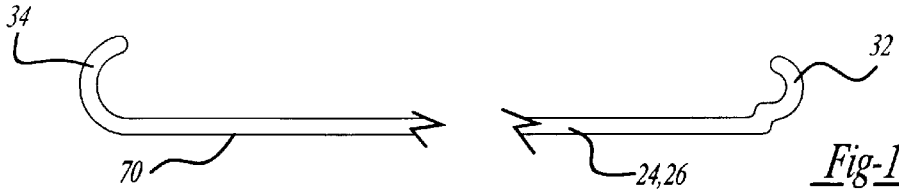
FIGS. 11A through 11D are views illustrating steps of a method, according to the present invention, of making the folded tube.
Figure 11B:
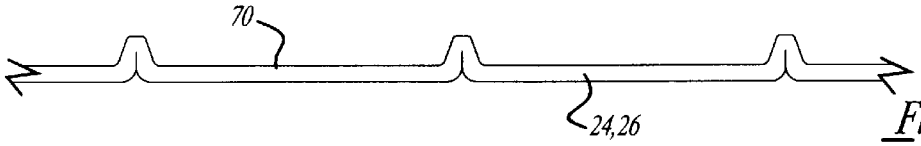
Figure 11C:
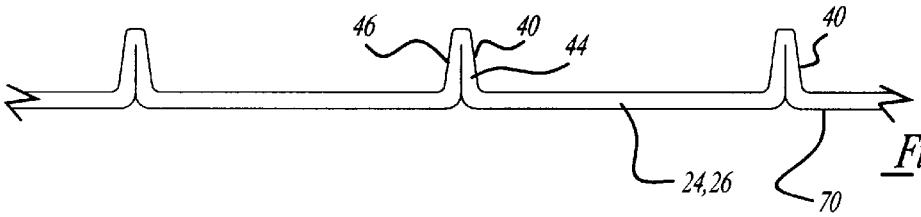
Figure 11D:
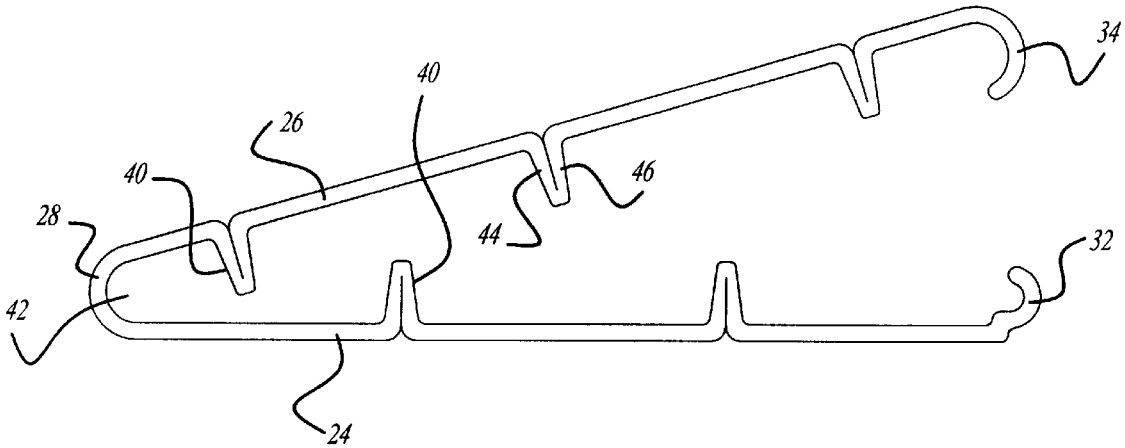

Referring to FIGS. 11A through 11D, a method, according to the present invention, of the making the folded tube 12 is shown. The method includes the steps of providing a generally planar sheet 70 of elongate, deformable material coated with a braze material forming the base 24 and top 26 having their respective ends 32 and 34 edges along a longitudinal length thereof as illustrated in FIG. 11A. The ends 32 and 34 of the base 24 and top 26 can be either flat or arcuate as illustrated in FIGS. 2 through 4. Alternatively, for the folded tube 112, 212 and 312, the ends can be formed as illustrated in FIGS. 6 through 9. The method includes the step of folding the sheet 70 from the lateral sides to initially form the internal webs 40 with the first fold portion 44 and second fold portion 46 to an initial predetermined web height and width as illustrated in FIG. 11B. The method also includes the step of compressing the internal webs 40 by lateral extrusion to extend the internal webs 40 to a final predetermined web height and width as illustrated in FIG. 11C. The step of compressing also includes the step of forming a taper or tapered angle on the internal webs 40 and coining the internal radiuses. The method includes the step of folding the ends 32 and 34 toward one another until they meet to form the first side 28 and second side 30 and ports 42 as illustrated in FIG. 11D. The method includes the step of connecting the ends 32 and 34 together as illustrated in FIG. 2. The method includes the step of brazing the folded tube 12 by heating the folded tube 12 to a predetermined temperature to melt the brazing material to braze the ends 32 and 34 and the internal webs 44 to the base 24 and/or top 26. The folded tube 12 is then cooled to solidify the molten braze material to secure the ends 32 and 34 together and the internal webs 44 and the base 24 and top 26 together. It should be appreciated that, instead of the ends 32 and 34, the partition 150,250,350 of the folded tube 112,212,312 may be formed according to the steps disclosed in U.S. Pat. NO. 5,579,837, the disclosure of which is hereby incorporated by reference. It should also be appreciated that the folded tube 412 may be formed as described above for the folded tube 12 except that the projections 462 or recesses 460 are formed during the step of compressing by the lateral extrusion.

Accordingly, the folded tube 12,112,212,312,412 is a cost reduction over current tubes. The folded tube 12,112,212, 312,412 has internal webs 40,140,240,340,440 that are folded and squeezed to maintain a predetermined distance between the top 26,126,226,326,426 and base 24,124,224, 324,424. The folded tube 12,112,212,312,412 also has the internal webs 40,140,240,340,440 forming ports 42,142, 242,342 with a hydraulic diameter preferably greater than 0.050 inches.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A folded tube for a heat exchanger comprising:

a base;

a top spaced from and opposing said base;

a first side interposed between said base and said top along one side thereof;

a second side interposed between said base and said top along another side thereof; and at least one of said base and said top having at least one internal web having an initial web height and being compressed to extend said at least one internal web to a final web height greater than said initial web height and defining a plurality of fluid ports, said at least one internal web having a first fold portion and a second fold portion adjacent said first fold portion and being formed from one of said base and said top, said at least one internal web having a web base and a web peak formed from said first fold portion and said second fold portion and said web base having a width greater than said web peak.

2. A folded tube as set forth in claim 1 wherein the fluid ports have a predetermined hydraulic diameter greater than 0.050 inches.

3. A folded tube as set forth in claim 1 wherein said at least one internal web has an initial web width and a final web width less that said initial web width.

4. A folded tube as set forth in claim 1 wherein said at least one internal web is tapered at a predetermined angle from said web base to said web peak.

5. A folded tube as set forth in claim 4 wherein said predetermined angle is greater than zero degrees and up to seven degrees from a vertical axis extending between said web base and said web peak.

6. A folded tube as set forth in claim 1 wherein said base includes a plurality of first internal webs and said top includes a plurality of second internal webs.

7. A folded tube as set forth in claim 6 wherein said first internal webs extend in one direction and the second internal webs extend in an opposite direction.

8. A folded tube as set forth in claim 7 wherein said first internal webs contact said second internal webs.

9. A folded tube as set forth in claim 7 including a partition extending from said top to said base and defining a pair of adjacent ports, said partition including a pair of opposing, contacting bend portions and a leg portion depending from each of said bend portions so as to contact said base.

10. A folded tube as set forth in claim 7 wherein said second side has a first end on said base and a second end on said top and overlapping said first end.

11. A folded tube as set forth in claim 7 wherein said internal webs includes either one of projections and recesses to enhance fluid flow.

12. A folded tube for a heat exchanger comprising:

a base;

a top spaced from and opposing said base;

a first side interposed between said base and said top along one side thereof;

a second side interposed between said base and said top along another side thereof; and said base and said top each having at least one internal web spaced laterally from each other and having an initial web height and being compressed to extend said at least one internal web to a final web height greater than said initial web height and defining a plurality of fluid ports, said at least one internal web having a first fold portion and a second fold portion adjacent said first fold portion and being formed from one of said base and said top, said at least one internal web having a web base and a web peak formed from said first fold portion and said second fold portion and said web base having a lateral width greater than a lateral width of said web peak, said base and said top and said first side and said second side and said at least one internal web being integral, unitary, and one-piece.

13. A method of making a folded tube for a heat exchanger comprising the steps of:

providing a generally planar sheet;

folding the sheet and forming at least one internal web having a first fold portion and a second fold portion;

compressing the at least one internal web to extend a height of the at least one internal web; and folding the sheet and forming a base and a top opposing the base and a first side interposed between the top and the base and a second side interposed between the top and the base such that the at least one internal web contacts either one of the top or the base to provide a plurality of fluid ports.

14. A method as set forth in claim 13 including the step of squeezing the at least one internal web to reduce a width of the at least one internal web.

15. A method as set forth in claim 13 including the step of forming a taper on the at least one internal web.

16. A method as set forth in claim 13 including the step of forming a plurality of internal webs.

17. A method as set forth in claim 16 including the step of alternating the internal webs to extend in opposite directions.

18. A method as set forth in claim 16 wherein said step of forming the internal webs to extend in only one direction.

19. A method as set forth in claim 16 wherein said step of providing the sheet with terminal ends and folding the terminal ends toward each other to form a partition between a pair of adjacent internal webs.

20. A method as set forth in claim 16 including the step of providing the sheet with terminal ends and folding the terminal ends toward each other in an overlapping manner to form the second side.

* * * * *